US006092828A

United States Patent [19]

Schumacher

[11] Patent Number: 6,092,828

[45] Date of Patent: Jul. 25, 2000

[54] SNOW SKI TRACTION DEVICE AND METHOD

[76] Inventor: David Schumacher, 1726 Ridge Rd., Scotia, N.Y. 12302

[21] Appl. No.: 09/133,644

[22] Filed: Aug. 13, 1998

[51] Int. Cl.[7] ..... A63C 7/10

[52] U.S. Cl. ..... 280/605; 188/6

[58] Field of Search ..... 280/604, 605, 280/28.11; 188/6, 8

[56] References Cited

U.S. PATENT DOCUMENTS

| | | | |
|---|---|---|---|
| 3,741,575 | 6/1973 | Bortoli . | |
| 3,785,663 | 1/1974 | Spieldiener et al. . | |
| 4,018,455 | 4/1977 | Bieler . | |
| 4,027,895 | 6/1977 | Larsson . | |
| 4,118,050 | 10/1978 | Schnurrenberger . | |
| 4,148,500 | 4/1979 | Nidecker . | |
| 4,227,708 | 10/1980 | Cote . | |
| 4,239,255 | 12/1980 | Boudreau et al. . | |
| 4,272,577 | 6/1981 | Lyng . | |
| 4,323,265 | 4/1982 | Benner . | |
| 4,363,497 | 12/1982 | Lacelle . | |
| 4,573,700 | 3/1986 | Beyl et al. | 280/605 |
| 4,595,215 | 6/1986 | Tiitola . | |
| 4,596,400 | 6/1986 | Stenius . | |
| 4,635,954 | 1/1987 | Arnsteiner . | |
| 4,674,764 | 6/1987 | Miesen . | |
| 4,844,501 | 7/1989 | Lekhtman | 280/605 |
| 4,898,401 | 2/1990 | Champagnac . | |
| 4,919,447 | 4/1990 | Jackson et al. . | |
| 5,221,104 | 6/1993 | Bejean et al. . | |
| 5,516,141 | 5/1996 | Stritzl et al. . | |
| 5,577,754 | 11/1996 | Hwu . | |
| 5,642,897 | 7/1997 | Coudere et al. . | |
| 5,839,746 | 11/1998 | Luitz | 280/605 |
| 5,931,481 | 8/1999 | Hoffman | 280/28.11 |

*Primary Examiner*—Paul N. Dickson
*Assistant Examiner*—Bridget Avery
*Attorney, Agent, or Firm*—Jay R. Yablon

[57] ABSTRACT

A snow ski traction device includes a traction blade pivotally mounted on blade-to-ski attachment device so as to secure the blade to the side of a snow ski. The blade pivots through a pivot arc of substantially 90 degrees and is stopped from pivoting outside of that arc. At one end of the arc, the length of the blade is substantially parallel to the length of the ski; while at the other end of the arc, it is perpendicular to the length of the ski. When perpendicular to the ski, the blade engages with and presses backwards against snow or ice beneath the ski, thus propelling the wearer of the ski in a forward direction and preventing backward slippage of the ski. When parallel to the ski, the blade permits a full, forward sliding movement of the ski. The ordinary motion of the ski causes the blade to pivot as required between these parallel and perpendicular positions. This device, and its method of use, are particularly applicable for cross-country skiing, though can be used by downhill skiers as well.

20 Claims, 4 Drawing Sheets

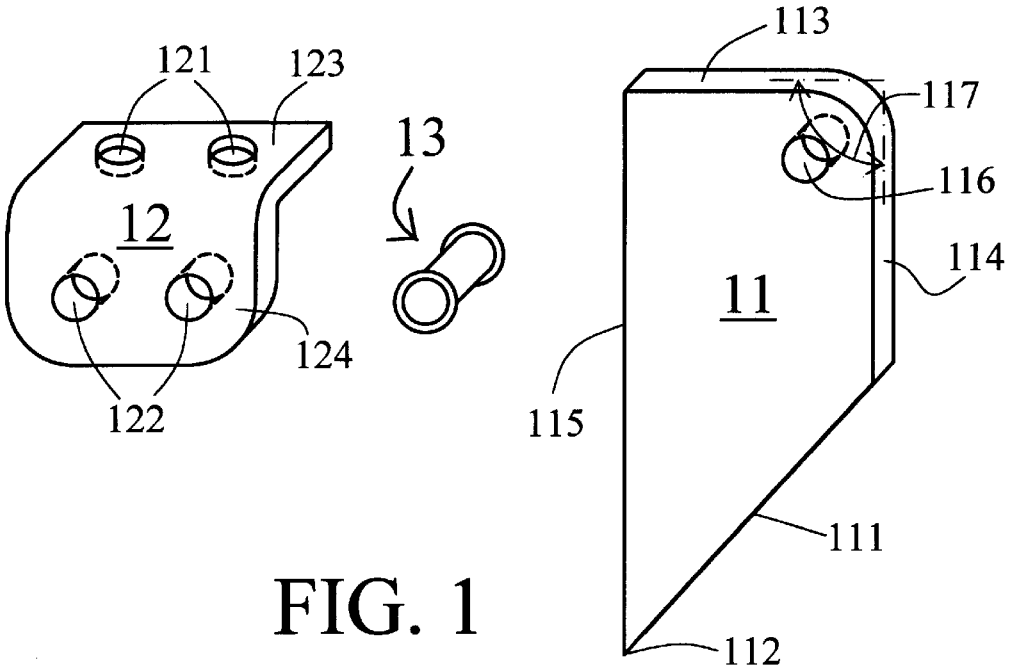
FIG. 1
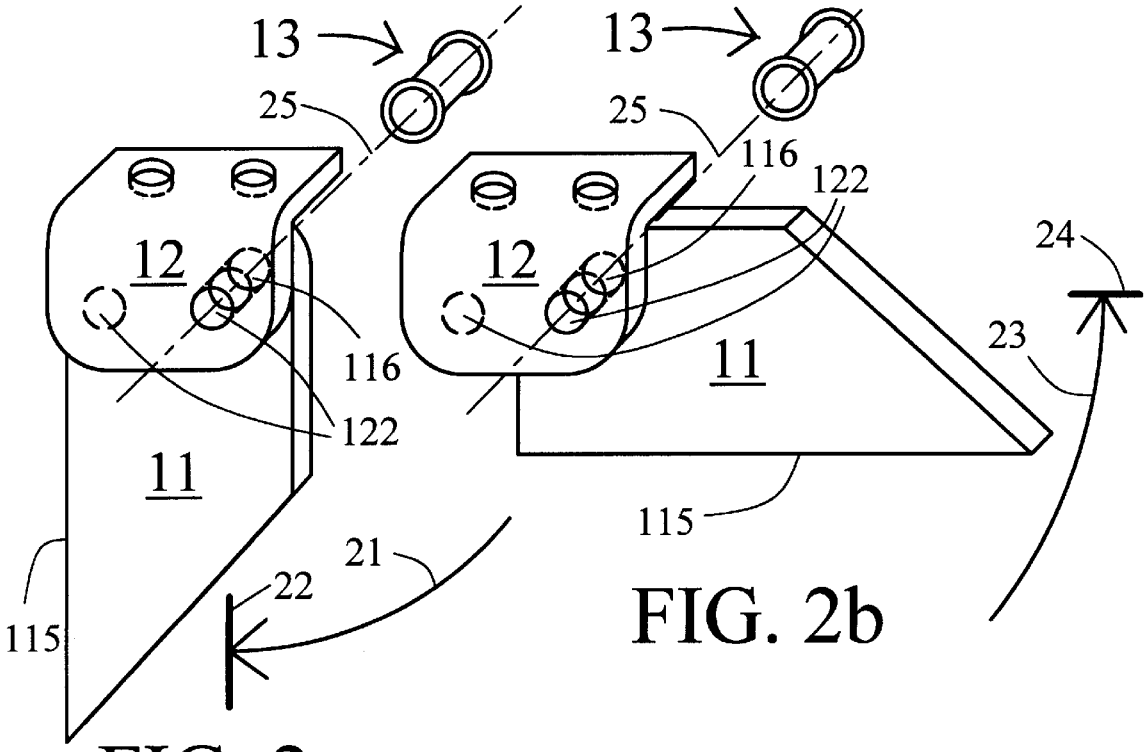
FIG. 2b
FIG. 2a

SNOW SKI TRACTION DEVICE AND METHOD

FIELD OF THE INVENTION

This invention relates generally to the field of skiing, and specifically relates to a device and method for preventing ski slippage in icy conditions.

BACKGROUND OF THE INVENTION

Cross-country skiing is a highly-popular winter sport throughout the United States and much of the world. While it is always desirable to ski in well-packed, fine snow powder, skiers do not always have this choice. Often, following a rain or a warmup followed by a freezedown, cross-country skiing paths will become riddled with icy spots, which makes skiing more difficult and hazardous.

The predominant leg motion of cross country skiing on a flat or uphill skiing surface involves taking a sliding step forward with one ski, while pushing back—ideally with minimal slippage—on the other ski. The predominant arm motion, in synchronization with this, is to plant one pole in the ground and push backward to gain traction for the sliding leg step forward, and to freely swing the other pole forward for replanting in the ground to aid the subsequent step forward. Generally, the left leg and the right arm push backward at the same time as the right leg and left arm move forward, and vice-versa.

While the backward pole push is the primary means for gaining traction in order to slide the skis forward, sometimes this is not sufficient. In icy conditions, the pole may not insert well into the ice, and the ski pushing backward cannot acquire enough traction and will slip backward rather than planting firmly and aiding the forward sliding of the opposite ski. It would, therefore, be desirable to have a simple device and method for improving ice traction, via the skis themselves.

The prior art reveals some attempts to address this problem, all of which fall short of an optimum solution. In general, the primary approach is to introduce an "asymmetry" into or onto the ski, so that the ski slides easily and offers minimal resistance when it is moved forward, while it plants firmly and offers solid traction when it is pushed backward.

U.S. Pat. Nos. 4,027,895; 4,118,050; 4,272,577; 4,323,265; 4,595,215; 4,635,954; and 4,919,447 all integrate some form of asymmetry directly into the fabrication of the skis themselves, involving, e.g., dual surfaces (U.S. Pat. No. 4,027,895), three-dimensional surfaces (U.S. Pat. No. 4,118,050), asymmetrically embedded particles (U.S. Pat. No. 4,272,577), fish-like scales (U.S. Pat. No. 4,323,265), grooves (U.S. Pat. No. 4,595,215), material coatings (U.S. Pat. No. 4,638,954), and fibers (U.S. Pat. No. 4,595,215). However, all of these solutions integrate fully with the fabrication and manufacture of the skis themselves. They are not at all useful to add traction to preexisting skis, not can they be employed for new skis without changing the fundamental design of the skis.

Add-on devices such as disclosed in U.S. Pat. Nos. 4,227,708; 5,516,141 and 5,642,897 are used as ski brakes, i.e., to stop the skis from moving forward. But what is needed here is a device to add traction, i.e., to stop the ski from moving backward. U.S. Pat. No. 4,363,497 is a traction device, but it is cumbersome to use, and in particular, requires engagement by the ski pole itself.

U.S. Pat. Nos. 4,148,500; 4,596,400; 4,674,764; 4,898,401; 5,221,104; and 5,577,754 appear to provide some added backward traction independent of the ski poles. However, these devices are all fairly complex involving numerous parts and springs, their attachment to a ski is complicated, and several appear to interfere with the ski in an undesirable manner.

Even for downhill skiing, there are times when a skier finds it necessary to walk forward on a ski, or perhaps up a section of hill, and it would be helpful if there existed an aid to gain traction for such an uphill walk.

Thus, would be desirable to have a traction device that is simpler, that is more easily added to the ski, and that operates only by virtue of the motion of the ski, totally independent of the ski pole.

OBJECTS OF THE INVENTION

It would be desirable to have an improved device and method to prevent cross country skis (and skis generally) from sliding backwards, especially in icy conditions, without sacrificing the ability of the skis to slide forward.

It is further desirable for this device and method to be independent of the skis themselves, so that preexisting skis and be easily retrofitted, and so that new skis can be manufactured without any fundamental changes in construction.

It is further desirable that this device and method operate independently of the use of ski poles.

It is further desirable that this device and method be easily attached to skis, have a minimum number of moving parts, be very simple to construct, avoid the use of springs or similar devices that can degrade over time and add mechanical complexity, and avoid interference with the primary forward-sliding motion of the skis.

SUMMARY OF THE INVENTION

A snow ski traction device according to the invention herein disclosed comprises a traction blade pivotally mounted on blade-to-ski attachment means so as to secure the blade to the side of a snow ski. The blade pivots through a pivot arc of substantially 90 degrees and is stopped from pivoting outside of that arc. At one end of the arc, the length of the blade is substantially parallel to the length of the ski; while at the other end of the arc, it is perpendicular to the length of the ski. When perpendicular to the ski, the blade engages with and presses backwards against snow or ice beneath the ski, thus propelling the wearer of the ski in a foreword direction and preventing backward slippage of the ski. When parallel to the ski, the blade permits a full, forward sliding movement of the ski. The ordinary motion of the ski causes the blade to pivot as required between these parallel and perpendicular positions.

This device, and its method of use, are particularly applicable for cross-country skiing, though can be used by downhill skiers as well to aid in any "walking" motions that they may need to engage in.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

FIG. 1 is a perspective view illustrating the preferred embodiment of the invention in a pre-assembly state, disassembled into it primary components.

FIG. 2 are perspective views illustrating the assembly of the preferred embodiment of the invention. FIG. 2*a* illustrates the invention it its traction-enhancing position, and FIG. 2*b* illustrates the invention in its sliding (no traction alteration) position.

DETAILED DESCRIPTION OF THE PREFERRED EMBODIMENT OF THE INVENTION

Figures 3A, 3B:
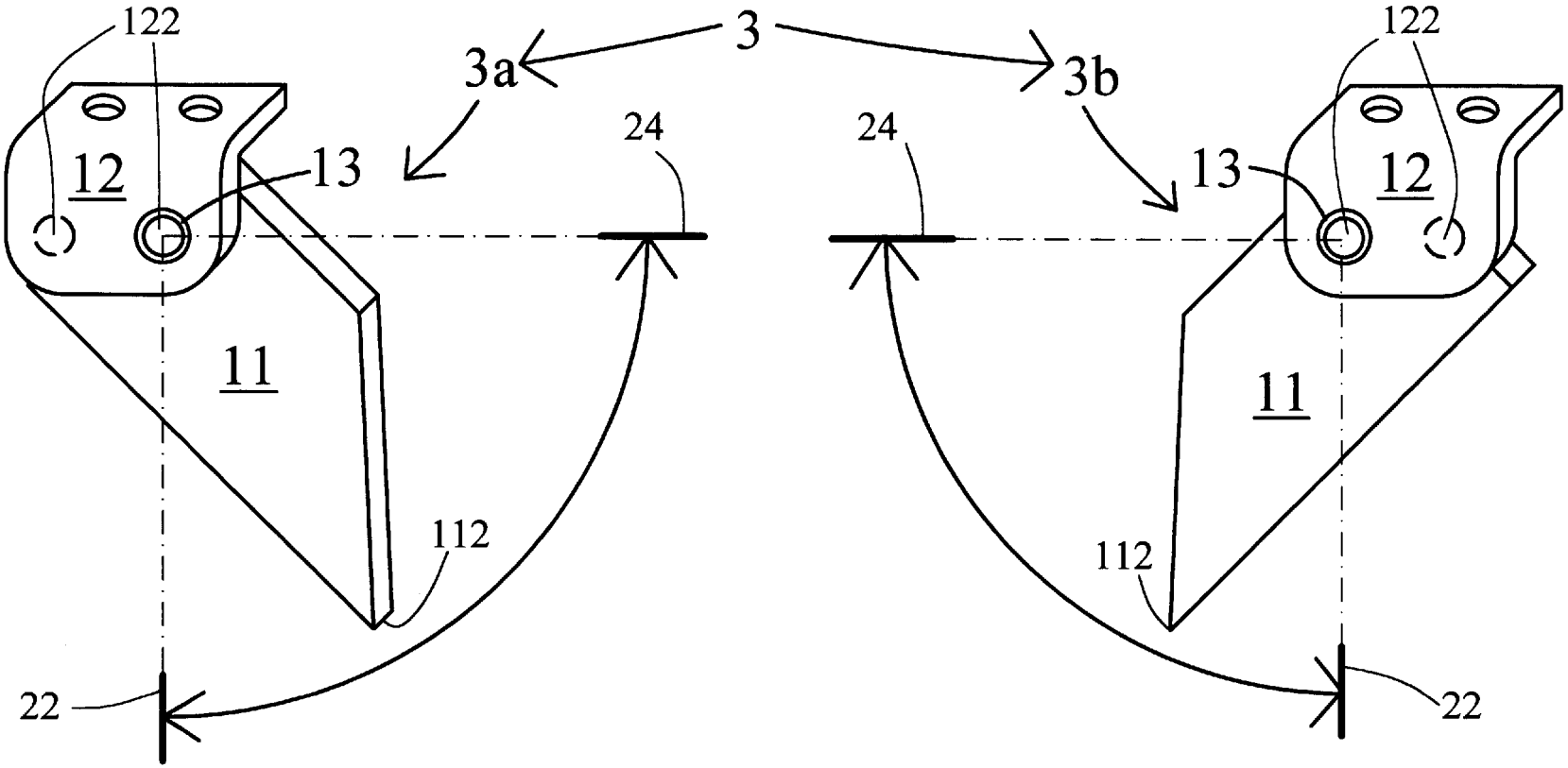
FIG. 3 are perspective views illustrating the fully-assembled snow ski traction device according to the preferred embodiment of the invention, in alternate parity configurations.

FIG. 1 illustrates the pre-assembly components of the preferred embodiment of the invention. These comprise traction blade means 11, blade-to-ski attachment means 12, and a pivotal attachment means 13 such as, but not limited to, a standard expansion pin as is well-known in the art.

Traction blade means 11 comprises a diagonal traction edge 111, a pivot-control means 112 such as the illustrated sharp point, traction position stop edge means 113, slide position stop edge means 114, and a slide edge 115. It also comprises a traction blade pivot hole 116. It is significant to note that the (pivot) angle 117 between traction position stop edge 113 and slide position stop edge 114 is substantially 90 degrees.

Blade-to-ski attachment means 12 comprises at least one ski attachment hole 121 punched through a substantially horizontal plane surface 123. For optimum stability, the preferred embodiment employs two such ski attachment holes 121. Blade-to-ski attachment means 12 also comprises at least one traction blade attachment hole 122 punched through a substantially vertical plane surface 124. The planes of surfaces 123 and 124 are substantially perpendicular to one another, as shown. In operation, as will be seen, only one traction blade attachment hole 122 is needed. However, the punching of two such holes 122 permits the invention to be assembled in both left- and right-handed parity versions, using identical blade-to-ski attachment means 12, since the right-most hole 122 is used for one parity, and the left-most hole 122 is used for the reverse parity.

FIGS. 2*a* and 2*b* illustrate the assembly of the invention, as well as the two primary positions (traction-enhancing and sliding) of the invention in operation. Assembly is very simple. Referring to either of FIG. 2, traction blade means 11 is placed behind blade-to-ski attachment means 12 and traction blade pivot hole 116 is lined up with one of the traction blade attachment holes 122, as shown. Traction blade means 11 is positioned such that in the traction-enhancing position of FIG. 2*a*, traction position stop edge 113 resides and butts substantially fully against the underside of horizontal plane surface 123, and it is this positioning that determines which of the traction blade attachment holes 122 is aligned with traction blade pivot hole 116. The remaining traction blade attachment hole 122, illustrated in FIG. 2 by a dotted line, is not used, but again, is available to enable reverse parity assembly using identically-manufactured blade-to-ski attachment means 12). Finally, pivotal attachment means 13 such as, but not limited to, a standard expansion pin, is inserted through the aligned holes 116 and 122 along centerline 25, and is pressed into place using techniques that are well-known in the art. Pivotal attachment means 13 should firmly and permanently secure traction blade means 11 to blade-to-ski attachment means 12 as shown, with only enough play so as to enable traction blade means 11 to swivel relative to blade-to-ski attachment means 12, as illustrated by arrows 21 and 23.

It is important to note that by virtue of the above-described configuration, traction blade means 11 is restricted to swivel through a restricted pivot arc of approximately 90 degrees. In particular, when traction blade means 11 is swiveled along arc 21 into the traction-enhancing position of FIG. 2*a*, traction position stop edge 113 (hidden) presses and butts firmly against the underside of horizontal plane surface 123, and so is prevented (stopped) from pivoting beyond traction position stop line 22. In this position, slide edge 115 is substantially perpendicular to horizontal plane surface 123 of blade-to-ski attachment means 12, and is proximate a forward region (toward the left in the illustration) of traction blade means 11, as illustrated.

Conversely, when traction blade means 11 is swiveled along arc 23 into the sliding position of FIG. 2*b*, part or all of slide position stop edge 114 comes to press firmly and butt substantially against the underside of horizontal plane surface 123, and so is prevented (stopped) from pivoting beyond slide position stop line 24. In this position, slide edge 115 is substantially parallel to horizontal plane surface 123 of blade-to-ski attachment means 12, and is proximate a bottom region of traction blade means 11, as illustrated.

It is understood that 90 degrees is the preferred measure for the restricted pivot arc, and that this is naturally imposed by virtue of the particular manner in which traction blade means 11 and blade-to-ski attachment means 12 are cut and attached to one another as heretofore illustrated and described. (Particularly, this is imposed by the substantially 90 degree (pivot) angle 117 between traction position stop edge 113 and slide position stop edge 114.) However, by obvious alterations to the cut and attachment of traction blade means 11 and blade-to-ski attachment means 12, it is clear that this restricted pivot arc can be made to vary from a lower limit of 80, 70 or even 60 degrees, to an upper limit of 100, 110 or even 120 degrees and still be within the scope of this disclosure and its associated claims. (Even wider variations are feasible from a manufacturing standpoint, though as will be seen below, these would at some point hinder the operational effectiveness of the invention.)

FIG. 3 illustrates the fully assembled snow ski traction device (3*a*, 3*b*) according to the preferred embodiment of the invention, in alternative parity assemblies. For reference independent of parity orientation, these will sometimes simply be referred to simply as snow ski traction device 3. FIG. 3*a* shows the snow ski traction device 3 assembled with the same parity (3*a*) as in FIG. 2*a*, while FIG. 3*b* shows a reverse parity assembly (3*b*). In each of FIG. 3, traction blade means 11 are shown pivoted approximately midway between traction position stop line 22 and slide position stop line 24. Note that traction blade means 11 is pivotally affixed to blade-to-ski attachment means 12 using pivotal attachment means 13 passed through one of the two traction blade attachment holes 122 and through traction blade pivot hole 116 (hidden). To achieve the parity reversal of FIG. 3*b* over FIG. 3*a*, one simply flips traction blade means 11 over, and attaches it through the alternate traction blade attachment holes 122. Thus, in FIG, 3*a*, traction blade 11 is attached through the right-most hole 122 and the left-most (dotted line) hole 122 is not used. In FIG. 3*b*, traction blade 11 is flipped, then attached through the left-most hole 122 and the right-most (dotted line) hole 122 is not used. As can be seen, this is why, by having both holes 122 punched into blade-to-ski attachment means 12, one can use an identical set of manufactured components 11, 12 and 13 per FIG. 1 to assemble a traction device 3 of either parity 3*a* or 3*b*.

It should also be apparent from all of the above, that application of a forward force (toward traction position stop line 22) against pivot-control means 112 will cause traction blade 11 to pivot into the traction-enhancing position of FIG. 2*a*, while application of a rearward force (toward slide position stop line 24) against pivot-control means 112 will cause traction blade 11 to pivot into the sliding position of FIG. 2*b*.

FIG. 4 illustrates the use of the preferred embodiment of the invention in combination with a ski to which it is attached. In this figure, snow ski traction device 3 (in the parity orientation 3*a* of FIG. 3*a*) is attached to a snow ski 40, a cutoff section of which is illustrated. Ski attachment means 41 such as, but not limited to, the simple screws illustrated in FIG. 4 are passed through ski attachment holes 121 (hidden) and sunk into ski 40 so as to affix traction device 3*a* (or it opposite-parity embodiment 3*b*) to ski 40 as shown. Of course, any other means obvious to someone of ordinary skill (e.g., gluing, nailing, welding, or even integral manufacture with the ski) to attach traction device 3*a* (or its opposite-parity embodiment 3*b*) to ski 40 as illustrated falls within the scope of this disclosure and its associated claims.

Figure 4A:
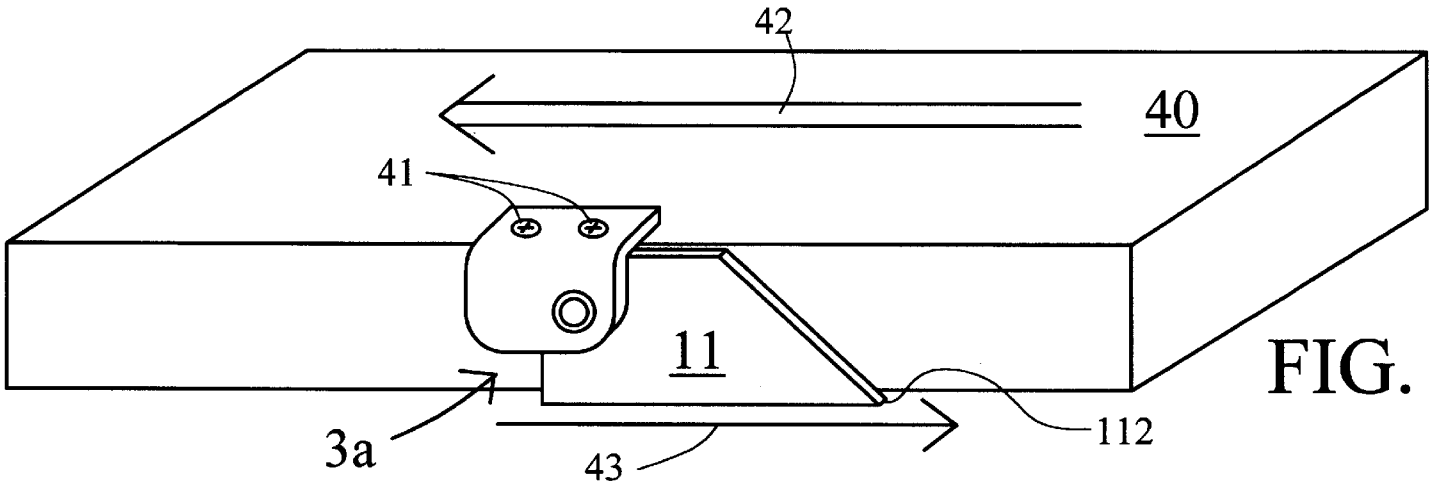
FIG. 4 illustrate the use of the preferred embodiment of the invention in combination with a section of a snow ski.

FIG. 4*a* illustrates the half-cycle of the skiing motion wherein the ski is being slid forward along directional arrow 42. This is when maximal sliding is desired, and when additional traction is not desired. In this half-cycle, the ground (snow or ice) moves backward relative to the ski along directional arrow 43, and will naturally, by virtue of this relative motion, cause traction blade means 11 to move (along arrow 23 of FIG. 2*b*) into its sliding (no traction alteration) position, as earlier shown and discussed in connection with FIG. 2*b*.

Figure 4B:
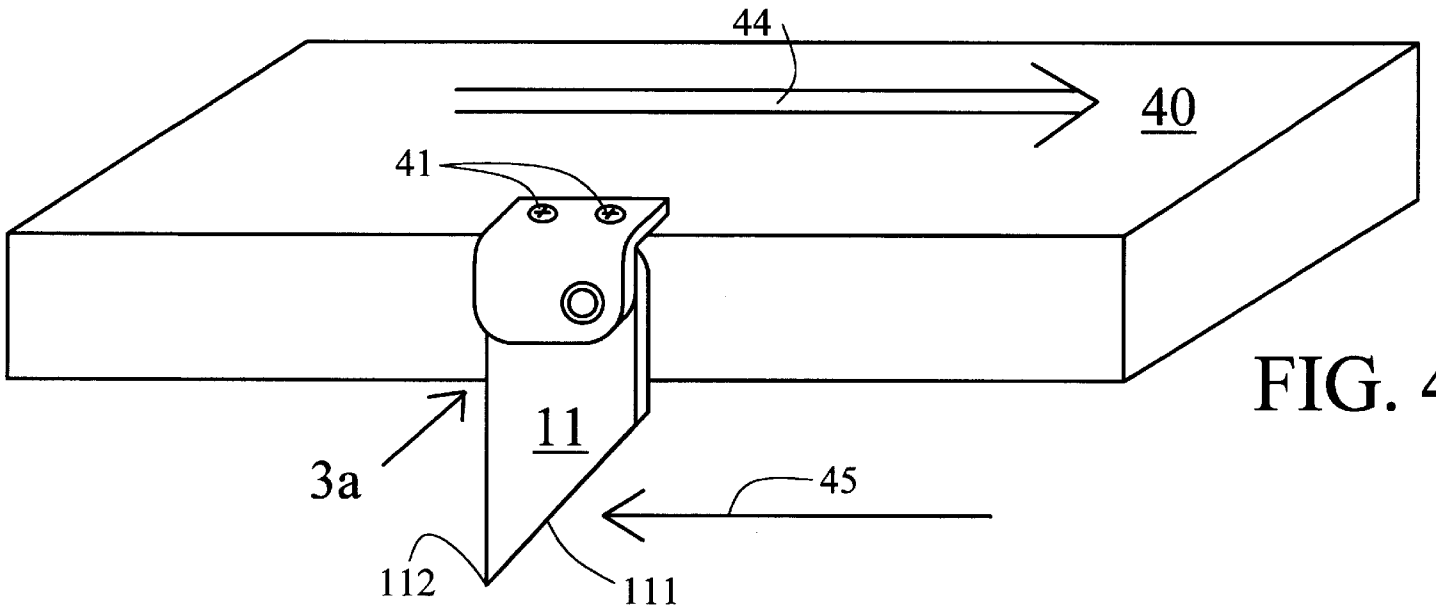

In FIG. 4*b*, however, the skier now enters the other half-cycle of the skiing motion, and begin to push backward on ski 40 along directional arrow 44. This is when extra traction to prevent backward slippage is desired. Here, the ground will tend to move forward relative to the ski along directional arrow 45. However, as soon as ski 40 is pushed backwards, pivot-control means 112 of traction blade means 11, such as the illustrated sharp point, will engage (dig into) the snow or ice beneath the ski. By virtue of this relative motion, the snow or ice will cause traction blade means 11 to move (along arrow 21 of FIG. 2*a*) into its traction-enhancing position, as earlier shown and discussed in connection with FIG. 2*a*. Once the position shown in FIGS. 2*a* and 4*b* is achieved, traction edge 111 will push back against the ice or snow beneath the ski, and will therefore stop backward slippage, while enhancing forward motion, in the desired, asymmetrical manner (forward sliding/backward traction).

In particular, the configuration earlier discussed in FIG. 2, that causes the forward rotation of traction blade means 11 to stop at traction position stop line 22, is what holds traction blade means 11 in the position required to properly enhance traction against backward slippage. Referring to FIGS. 2 and 4, because traction blade means 11 cannot pivot beyond traction position stop line 22, traction edge 111 will dig into the skiing surface, opposing and preventing backward slippage. Conversely, slide position stop line 24 maintains traction blade means 11 and particularly slide edge 115, in a position parallel to the ski surface. As a result, slide edge 115 engages the snow in the same manner as a skate blade, offering minimal resistance to forward skiing movement.

In this context, it will be appreciated that a substantially 90 degree rotation for traction blade means 11 (see angle 117 in FIG. 1, as well as the roughly 90 degree rotation between stop lines 22 and 24 in FIG. 3) is preferred and will optimize the benefit derived according to the invention, but that other angles of rotation can also afford useful benefit within the scope of this disclosure and its associated claims.

In the preferred embodiment of the invention, a snow ski traction device 3*a* or 3*b*, in the parity orientations of FIG. 3*a* or 3*b*, is attached to the outside or inside, respectively, of snow ski 40 worn on the skier's left leg. A second snow ski traction device 3*b* or 3*a*, in the parity orientation of FIG. 3*b* or 3*a*, is attached to the outside or inside, respectively, of a snow ski 40 worn on the skier's right leg. In the preferred embodiment, traction device 3 is attached to the ski proximate the front of the ski boot. However, attachment to the ski at anywhere between 25% and 75%, and even 10% and 90%, along the ski length as measured from the front to the back of the ski, and indeed, anywhere upon the ski, is considered within the scope of this disclosure and its associated claims.

Thus, each ski has at least one such device 3*a*, 3*b* attached to it, and the reverse parity ensures that the traction/sliding asymmetry can be properly oriented in any configuration. However, it is fully within the scope of this disclosure and its associated claims to use one, or more than one (at least one) such device 3*a*, 3*b* on each ski, and to attach said device(s) to the inside, outside, or both, as desired, at any point along the ski. Based on outside-left and outside-right ski attachments, the parity orientation of devices 3*a* and 3*b* will be respectively be referred to as "left ski" and "right ski" parities.

Figure 5B:
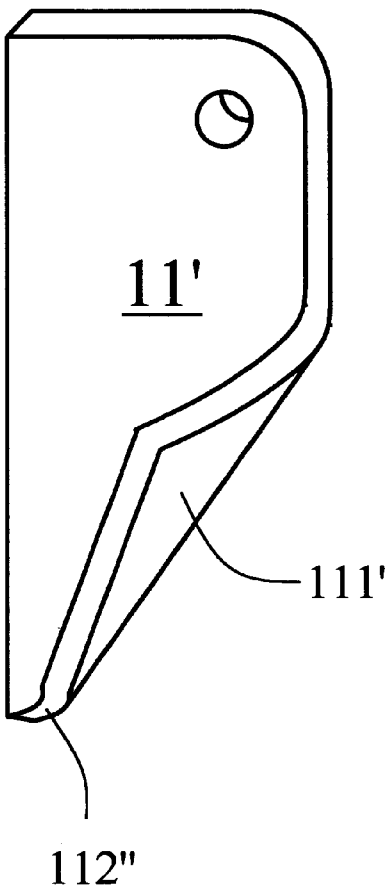
FIG. 5 illustrate the traction blade of the invention in an alternate preferred embodiment.
Figure 5A:
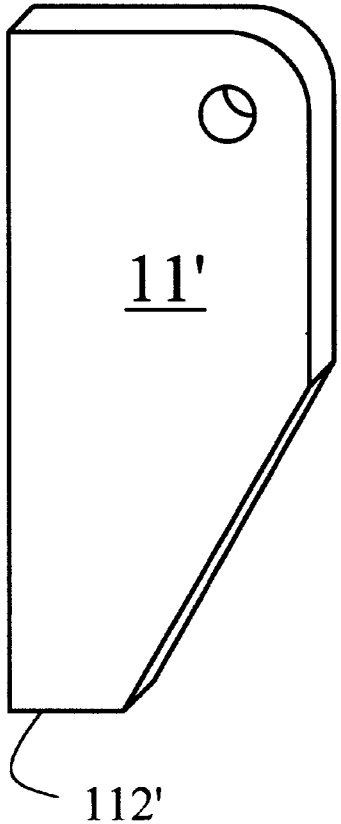

FIG. 5*a* illustrates an alternative preferred embodiment for traction blade means 11, herein designated 11'. Pivot-control means 112, previously a sharp point in FIG. 1, is now a flat edge labelled by 112'. All else is identical to what was shown and discussed for FIG. 1. This blade embodiment 11' can be utilized in combination with the remaining blade-to-ski attachment means 12 and pivotal attachment means 13 of FIG. 1 as earlier discussed, and its use and operation is otherwise identical to what was discussed in connection with FIGS. 1 through 4.

Alternatively, as shown in FIG. 5*b*, blade means 11' (or 11) can be folded along a diagonal line as shown to form folded diagonal traction edge 111'. This folded traction edge 111', because of the fold, provides a greater surface area to oppose snow of ice beneath the ski, serving to further facilitate traction. Its pivot control means 112" is also less sharp than the point 112 of FIG. 1, and would be less likely to cause injury in the event someone was to be accidentally struck by pivot control means 112", either during a skiing fall, or while the ski is being transported.

It can readily be appreciated from FIG. 5 that a variety of traction blades 11, 11' can be designed according to the invention which will achieve the objects of the invention in the same manner as those blades explicitly illustrated herein. More generally, it will be apparent to someone of ordinary skill that the design detail of the various components such as traction blade means 11, blade-to-ski attachment means 12, and pivotal attachment means 13, as well as the specific means used to connect these components together as well as to skis 40, can be varied and modified without deviating from the essential scope of this disclosure and its associated claims.

It is noteworthy that the dynamic operation of this invention is controlled completely by the natural leg motion of the skier. When the skier presses backwards, traction blade 11, 11' pivots down into the perpendicular (to the ski) position of FIG. 4*b* and FIG. 2*a*, and then, by virtue of the stop 22, presses backwards against the ice or snow to enhance forward traction. As soon as the skier stop pressing backwards, and allows the ski to slide forward, traction blade 11, 11' pivots back into the parallel (to the ski) position of FIG. 4*a* and FIG. 2*b*, and readily slides forward with the ski, without altering the ski's traction. All pivotal motion of the traction device 3 is controlled by the engagement of pivot-control means 112, 112', 112" with the snow and/or ice surface below. No springs or other dynamic driving mechanisms are needed, and indeed, the overall invention has very few parts, each of which is very simple. Not only can this device readily be manufactured integrally with new skis if desired; but it can easily be retrofitted to attach to a preexisting set of skis without having to purchase new skis. By virtue of its simplicity, it can be manufactured as a simple piece of hardware and sold at low cost.

While the preferred use of this device is for cross country skiing, where the primary motion is a back and forth stepping motion and where it is desirable to introduce an asymmetry that adds traction against backward movement while leaving forward movement unencumbered, it will be appreciated that this device will also work well with downhill skis. While the skier moves downhill in a forward direction, traction blade 11 will reside parallel to the ski and not impact traction at all. But if the skier is faced with the need to walk forward on the skis, or to climb a hill in a forward-facing position, the traction-enhancing function of the invention will be useful on the downhill skis as well to facilitate any such "walking" motion.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A snow ski traction device comprising:

traction blade means for enhancing traction;

blade-to-ski attachment means for attaching said blade means to a ski;

pivotal attachment means pivotally attaching said traction blade means to said blade-to-ski attachment means; and traction position stop edge means for preventing said traction blade means from pivoting past a predetermined traction position stop line; wherein, when said traction blade means is pivoted into a traction-enhancing position, said traction position stop edge means butts substantially against an underside of a horizontal plane surface of said blade-to-ski attachment means.

2. The snow ski traction device of claim 1, said traction blade means further comprising:

slide position stop edge means; wherein when said traction blade means is pivoted into a sliding position, said slide position stop edge means butts substantially against said underside of said horizontal plane surface of said blade-to-ski attachment means thereby preventing said traction blade means from pivoting past a slide position stop line.

3. The snow ski traction device of claim 2, said traction blade means further comprising a slide edge; wherein in said traction-enhancing position, said slide edge of said traction blade means is approximately perpendicular to said horizontal plane surface of said blade-to-ski attachment means, and is proximate a forward region of said traction blade means; and wherein in said sliding position, said slide edge of said traction blade means is approximately parallel to said horizontal plane surface of said blade-to-ski attachment means, and is proximate a bottom region of said traction blade means.

4. The snow ski traction device of claim 2, said traction blade means further comprising pivot control means; wherein application of a forward force against said pivot control means of said traction blade means causes said traction blade means to pivot into said traction-enhancing position; and wherein application of a rearward force against said pivot control means of said traction blade means causes said traction blade means to pivot into said sliding position.

5. The snow ski traction device of claim 3, said traction blade means further comprising pivot control means; wherein application of a forward force against said pivot control means of said traction blade means causes said traction blade means to pivot into said traction-enhancing position; and wherein application of a rearward force against said pivot control means of said traction blade means causes said traction blade means to pivot into said sliding position.

6. The snow ski traction device of claim 2, wherein:

said traction position stop edge means is at a predetermined pivot angle of between 60 and 120 degrees relative to said slide position stop edge means; and wherein, as a consequence thereof, a pivot angle of said traction blade means when in said traction enhancing position differs from said pivot angle of said traction blade means when in said sliding position by a restricted pivot arc angle that is substantially of the same magnitude as said predetermined pivot angle.

7. The snow ski traction device of claim 2 in combination with a snow ski, wherein:

said snow ski traction device, and said traction blade means thereof, are attached to said snow ski by attaching said blade-to-ski attachment means to said ski.

8. The combination of claim 7, said traction blade means further comprising pivot control means; wherein pressing said snow ski backwards against a skiing surface causes a forward reaction force to be applied against said pivot control means of said traction blade means, thereby further causing said traction blade means to pivot into said traction-enhancing position; and wherein sliding said snow ski forward along said skiing surface causes a rearward reaction force to be applied against said pivot control means of said traction blade means, thereby further causing said traction blade means to pivot into said sliding position.

9. The combination of claim 8, said traction blade means further comprising:

a traction edge; and a slide edge; wherein so-preventing said traction blade means from pivoting past said predetermined traction position stop line further causes a traction force to be applied backward against said skiing surface via said traction edge of said traction blade means, when said snow ski is so-pressed backwards against said skiing surface and once said traction blade has so-pivoted into said traction-enhancing position; and wherein so-preventing said traction blade means from pivoting past said slide position stop line positions said slide edge of said traction blade means to slide forward through said skiing surface with substantially no resistance, when said snow ski is so-slid forward along said skiing surface and once said traction blade has so-pivoted into said sliding position.

10. A method for enhancing the traction of a snow ski, comprising the steps of:

providing for attachment to a snow ski, a snow ski traction device comprising:

traction blade means for enhancing traction;

blade-to-ski attachment means for attaching said blade means to a ski; and pivotal attachment means pivotally attaching said traction blade means to said blade-to-ski attachment means; and preventing said traction blade means from pivoting past a predetermined traction position stop line when said traction blade means is pivoted into a traction-enhancing position, by substantially butting traction position stop edge means of said traction blade means against an underside of a horizontal plane surface of said blade-to-ski attachment means.

11. The method of claim 10, comprising the further step of:

preventing said traction blade means from pivoting past a predetermined slide position stop line when said traction blade means is pivoted into a sliding position, by substantially butting slide position stop edge means of said traction blade means against said underside of said horizontal plane surface of said blade-to-ski attachment means.

12. The method of claim 11, wherein:

in said traction-enhancing position, said slide edge of said traction blade means is approximately perpendicular to said horizontal plane surface of said blade-to-ski attachment means, and is proximate a forward region of said traction blade means; and wherein in said sliding position, said slide edge of said traction blade means is approximately parallel to said horizontal plane surface of said blade-to-ski attachment means, and is proximate a bottom region of said traction blade means.

13. The method of claim 11, comprising the further steps of: pivoting said traction blade means into said traction-enhancing position by applying a forward force against pivot control means of said traction blade means; and pivoting said traction blade means into said sliding position by applying a rearward force against said pivot control means of said traction blade means.

14. The method of claim 12, comprising the further steps of:

pivoting said traction blade means into said traction-enhancing position by applying a forward force against pivot control means of said traction blade means; and pivoting said traction blade means into said sliding position by applying a rearward force against said pivot control means of said traction blade means.

15. The method of claim 11, comprising the further step of:

providing said traction position stop edge means at a predetermined pivot angle of between 60 and 120 degrees relative to said slide position stop edge means; as a consequence thereof, a pivot angle of said traction blade means when in said traction enhancing position differing from said pivot angle of said traction blade means when in said sliding position by a restricted pivot arc angle that is substantially of the same magnitude as said predetermined pivot angle.

16. The method of claim 11, comprising the further steps of:

attaching said snow ski traction device, and said traction blade means thereof, to said snow ski by attaching said blade-to-ski attachment means to said ski.

17. The method of claim 16, comprising the further steps of:

pivoting said traction blade means into said traction-enhancing position by pressing said snow ski backwards against a skiing surface and thereby applying a forward reaction force against pivot control means of said traction blade means; and pivoting said traction blade means into said sliding position by sliding said snow ski forward along said skiing surface and thereby applying a rearward reaction force against said pivot control means of said traction blade means.

18. The method of claim 17, comprising the further steps of:

applying a traction force backward against said skiing surface via a traction edge of said traction blade means, when pressing said snow ski backwards against said skiing surface, and once said traction blade has so-pivoted into said traction-enhancing position, by so-preventing said traction blade means from pivoting past said predetermined traction position stop line; and positioning a slide edge of said traction blade means to slide forward through said skiing surface with substantially no resistance, when so-sliding said snow ski forward along said skiing surface, and once said traction blade has so-pivoted into said sliding position, by so-preventing said traction blade means from pivoting past said predetermined slide position stop line.

19. A method for adding traction to a snow ski against backward sliding, comprising the steps of:

pivotally attaching a traction blade to said snow ski;

pivoting said traction blade from a sliding position into a traction-enhancing position by pressing said snow ski backwards against a skiing surface and thereby applying a forward reaction force against pivot control means of said traction blade;

preventing said traction blade from pivoting past a predetermined traction position stop line when said traction blade is so-pivoted into a traction-enhancing position by substantially butting traction position stop edge means of said traction blade against an underside of a horizontal plane surface of a blade-to-ski attachment means; and thereby applying a traction force backward against said skiing surface via a traction edge of said traction blade, when so-pressing said snow ski backwards against said skiing surface, and once said traction blade has so-pivoted into said traction-enhancing position, by so-preventing said traction blade from pivoting past said predetermined traction position stop line.

20. The method of claim 18, comprising the further steps of:

pivoting said traction blade from said traction-enhancing position into said sliding position by sliding said snow ski forward along said skiing surface and thereby applying a rearward reaction force against said pivot control means of said traction blade;

preventing said traction blade from pivoting past a predetermined slide position stop line when said traction blade is so-pivoted into a sliding position; and thereby positioning a slide edge of said traction blade to slide forward through said skiing surface with substantially no resistance, when so-sliding said snow ski forward along said skiing surface, and once said traction blade has so-pivoted into said sliding position, by so-preventing said traction blade from pivoting past said slide position stop line.

* * * * *